United States Patent [19]

Fischer

[11] 4,094,207

[45] June 13, 1978

[54] DRIVE ARRANGEMENT PARTICULARLY FOR A TOY MODEL

[76] Inventor: Artur Fischer, Weinhalde 34, D-7244 Waldachtal 3 (Tumlingen), Germany

[21] Appl. No.: 765,801

[22] Filed: Feb. 4, 1977

[30] Foreign Application Priority Data

Feb. 12, 1976 Germany ..... 7603968[U]

[51] Int. Cl.[2] ..... F16H 1/16

[52] U.S. Cl. ..... 74/425

[58] Field of Search ..... 74/425, 424.5, 424.7, 74/421 A

[56] References Cited

U.S. PATENT DOCUMENTS

| | | | |
|---|---|---|---|
| 2,925,170 | 2/1960 | Rath et al. | 74/425 X |
| 3,866,486 | 2/1975 | Lechner | 74/425 |

*Primary Examiner*—Leonard H. Gerin
*Attorney, Agent, or Firm*—Michael J. Striker

[57] ABSTRACT

A drive arrangement particularly for a toy model assembled of component parts has a housing having a wall, a motor means with a drive screw extending through the wall of the housing, and a drive gear adapted to mesh with the drive screw and mounted on an axle. A first connecting portion is provided on the wall of the housing. An adapter member having a recess for passage of the drive screw therethrough is engageable with and movable over the first connecting portion so as to be mounted on the wall of the housing. A second connecting portion is provided on the adapter member, which second connecting portion is elongated in a direction substantially normal to the direction of movement of the adapter member. An axle support member supports the axle of the gear wheel and is movable in the second direction over the second connecting portion so as to be mounted on the adapter member and thereby on the wall of the housing. Means for limiting the movement of the adapter member are further provided.

6 Claims, 1 Drawing Figure

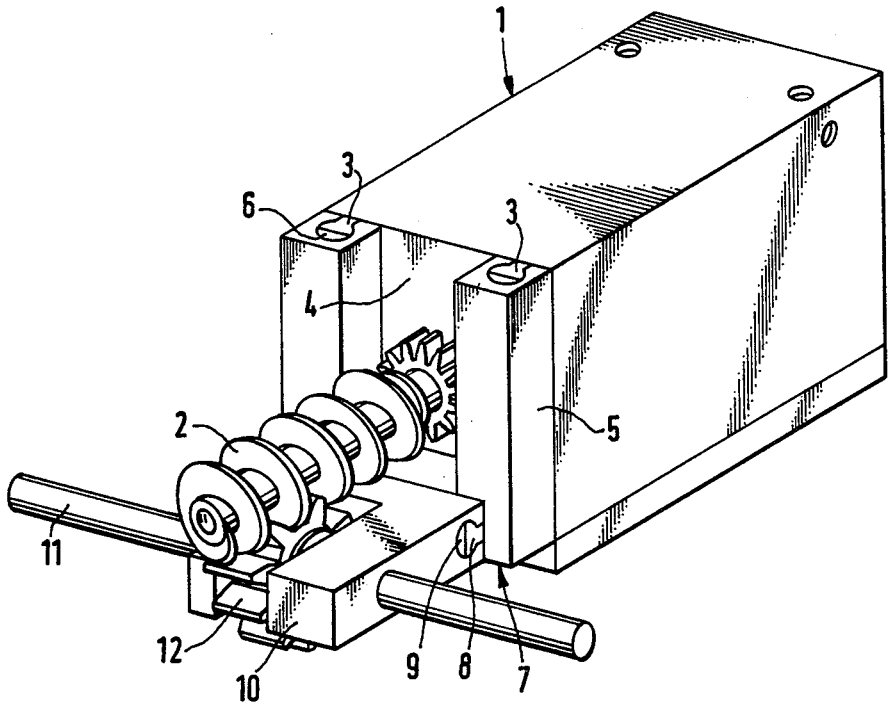
1
3
6
3
4
2
5
11
12
10
9
8
7

DRIVE ARRANGEMENT PARTICULARLY FOR A TOY MODEL

BACKGROUND OF THE INVENTION

The present invention relates to a drive arrangement for a toy model assembled of component parts, and more particularly to a drive arrangement comprising a housing, a motor enclosed in the housing and having a drive screw extending through a wall of the housing, and connecting means provided on the wall of the housing for mounting thereon the component parts particularly gear parts adapted to mesh with the drive screw.

Drive arrangements have been proposed which comprise housing having a wall, a motor with a drive screw extending through the wall of the housing and connecting member having undercut rods mounted on the wall of the housing so that mounting of gear parts can be performed only by engaging with front side portions of the connecting member. In this case both the construction of the connecting member and the method of connection preclude provision of a further connecting member extending normal to the above-mentioned connecting member. In such construction an axle of the gear wheel mounted on an axle support is brought in alignment with the undercut rods of the connecting member, that is extends in the same direction in which the connecting member extends. However, in assembling of the toy models and particularly toy vehicles it is often desirable to obtain the orientation of the axle of the gear wheel which is normal to the orientation of the already mounted component parts. The above-mentioned orientation of the axle of the gear wheel cannot be obtained in the construction known in the above-discussed art.

SUMMARY OF THE INVENTION

Accordingly, it is a general object of the present invention to avoid the disadvantages of the prior art drive arrangement for toy models assembled of component parts.

More particularly, it is an object of the present invention to provided an improved drive arrangement for toy model which permits mounting of an axle of a gear wheel by movement in both coordinate directions.

Another object of the present invention is to provide an improved drive arrangement for a toy model which does not require an additional support for an axle of a gear wheel and comprises minimum component parts.

Still another object of the present invention is to provide a drive arrangement which is compact, convenient in use and efficiently performs the desirable functions.

In keeping with these objects, and with others which will become apparent hereafter, one feature of the present invention, briefly stated, is that a first connecting portion is provided on a wall of a housing, through which wall a drive screw extends, an adapter member is engageable with the first connecting portion and movable thereover in a first direction, a second connecting portion is provided on the adapter member and is elongated in a second direction isubstantially normal to the first direction, and an axle supporting member, supporting an axle of a gear wheel adapted to mesh with the drive screw, is engageable and movable over the second connecting portion to thereby be mounted in a position in which the gear wheel meshes with and is driven by the drive screw. In the above described construction the axle of the gear wheel is mountable by movement in both coordinate directions. The motor, in connection with the adapter member and the supporting member, is very compact, and only insertion of gear means meshed with one another is required to complete assembling of the arrangement. There is no necessity in any additional support for the axle of the gear wheel. The toy model is compact, convenient in use and efficiently performs its functions, because the drive axle and the drive arrangement are positively connected with one another by means of the adapter member.

Another feature of the present invention is that the first connecting portion for movement of the adapter member is formed as elongated undercut projections mounted on the wall of the housing, and the adapter member has undercut grooves engageable with the undercut projections. On the other hand, the second connecting portion comprises a further elongated undercut projection mounted on the adapter member, and the axle support member has a further undercut groove extending in the second direction and engageable with the further undercut projection. Due to the above-mentioned construction, the gear wheel is mounted on the adapter member and thereby on the wall of the housing simply and conveniently.

Still another feature of the present invention is embodied in means for limiting the movement of the adapter member in the first direction, which means are formed as closed end portions of the grooves provided in the adapter member for engagement with the elongated connecting portions of the housing. These means preclude undesirable displacement of the adapter member relative to the wall of the housing, and at the same time this assures the necessary meshing engagement of the drive screw with the gear wheel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a perspective view of a drive arrangement for a toy model embodying the present invention.

DESCRIPTION OF THE PREFERRED EMBODIMENT

Discussing now the drawing in detail, it will be seen that a drive arrangement, particularly for a toy model assembled of components parts, in accordance with the present invention has a housing 1 enclosing a motor, which motor is known per se and is not shown in the drawing. The motor has a drive screw 2 extending through a front wall of the housing 1.

An adapter member 5 is mountable on the front wall of the housing 1 and has a recess 4 for passage of the drive screw 2 through the latter. For mounting of the adapter member 5 on the front wall of the housing 1, two connecting portions are arranged on the front wall of the housing 1, which connecting portions are formed as elongated undercut projections 3. On the other hand, the adapter member 5 has two undercut grooves 6 each corresponding to a respective one of the undercut projections 3 and engageable with the same. In such construction mounting of the adapter member 5 on the front wall of the housing 1 is performed by engaging the undercut grooves 6 of the adapter member 5 with the undercut projections 3 of the housing 1 and subsequently sliding the former over the latter.

Each of the undercut grooves 6 of the adapter member 5 has a leading end portion first engaging with the respective one of the undercut projections 3 of the housing 1, and a trailing end portion spaced from the leading end portion in a direction of the movement of the adapter member 5 over the housing 1. The trailing end portion of each of the undercut grooves 6 is closed so that the latter in the end of the movement of the adapter member 5 presses against the respective undercut projection 6 of the housing 1 and thereby forms means 7 for limiting the movement of the adapter member 5 relative to the housing 1.

A gear wheel 12 is adapted to mesh with the drive screw 2 of the motor and is mounted on an axle 11, which axle 11, in turn, is supported by an axle supporting member 10. The axle supporting member 10 is mountable on the adapter member 5. For mounting of the axle supporting member 10 a further connecting portion is arranged on the adapter member 5, which connecting portion is formed as a further elongated undercut projection 8 normal to the undercut grooves 3. On the other hand, the axle supporting member 10 has a further undercut groove 9 corresponding to the further undercut projection 8 of the adapter member 5. Mounting the axle supporting member 10 on the adapter member 5 is performed by engaging the further undercut groove 9 of the axle supporting member 10 with the further undercut projection 8 of the adapter member 5 and subsequently sliding the former over the latter, in a direction normal to the direction in which the adapter member 5 is moved over the undercut projections 3 of the housing 1.

For mounting the above-described compact drive arrangement particularly, to a toy vehicle model, the housing 1 of the arrangement is provided with additional connecting means, which connecting means are preferably arranged on the upper and rear wall of the housing 1.

It will be understood that each of the elements described above, or two or more together, may also find a useful application in other types of constructions differing from the types described above.

While the invention has been illustrated and described as embodied in a drive arrangement particularly for a toy model, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A drive arrangement, particularly for a toy model assembled of component parts, comprising a housing having a wall; motor means housed in said housing and having a drive screw extending through said wall; a gear wheel adapted to mesh with said drive screw and being mounted on an axle; a first connecting portion provided on said wall and being elongated in a first direction, said first connecting portion comprising elongated undercut projections mounted on said wall of said housing; an adapter member engageable with and movable over said undercut projections of said first connecting portion in said first direction so as to be mounted on said wall of said housing, said adapter member having a recess for passage of said drive screw therethrough; a second connecting portion provided on said adapter member and being elongated in a second direction substantially normal to said first direction; and an axle supporting member supporting said axle of said gear wheel, said axle supporting member being engageable with and movable over said second connecting portion, in said second direction so as to be mounted on said adapter member and thereby on said wall of said housing in a position in which said gear wheel meshes with and is driven by said drive screw.

2. The drive arrangement is defined in claim 1, wherein said adapter member has undercut grooves each corresponding to a respective one of said undercut projections and engageable with the same.

3. The drive arrangement as defined in claim 1, wherein said second connecting portion comprises a further elongated undercut projection on said adapter member, said axle support member being engageable with said undercut projections and movable thereover in said first direction.

4. The drive arrangement as defined in claim 3, wherein said axle support member has a further undercut groove extending in said second direction and engageable with said further undercut projection.

5. The drive arrangement as defined in claim 1; and further comprising means for limiting the movement of said adapter member over said first connecting portion in said first direction.

6. The drive arrangement as defined in claim 5, wherein said first connecting portion comprises undercut projections on said wall of said housing, said adapter member having undercut grooves engageable with said undercut projections of said first connecting portion, each of said undercut grooves having a leading end portion first engaging with the respective one of said undercut projections and a trailing end portion spaced from said leading end portion in said first direction, said trailing end portions being closed so as to form said means for limiting the movement of said adapter member in said first direction.

* * * * *